US011766606B1

(12) United States Patent
Brattesani

(10) Patent No.: US 11,766,606 B1
(45) Date of Patent: Sep. 26, 2023

(54) FLIPPING BOUNCE GAME

(71) Applicant: Robert J. Brattesani, Copperopolis, CA (US)

(72) Inventor: Robert J. Brattesani, Copperopolis, CA (US)

( * ) Notice: Subject to any disclaimer, the term of this patent is extended or adjusted under 35 U.S.C. 154(b) by 69 days.

(21) Appl. No.: 17/302,912

(22) Filed: May 14, 2021

Related U.S. Application Data

(60) Provisional application No. 63/025,783, filed on May 15, 2020.

(51) Int. Cl.
*A63F 9/02* (2006.01)

(52) U.S. Cl.
CPC ..... *A63F 9/0278* (2013.01); *A63F 9/0204* (2013.01); *A63F 2009/0282* (2013.01)

(58) Field of Classification Search
CPC ..... A63F 9/0278; A63F 9/0204; A63F 2009/0282; A63B 67/19; A63B 67/187; A63B 2102/04
See application file for complete search history.

(56) References Cited

U.S. PATENT DOCUMENTS 2,085,717 A * 6/1937 Lashley ..... A63B 67/183 264/277
2,360,173 A * 10/1944 Tanger ..... A63B 67/18 D21/711
2,485,420 A * 10/1949 Timpe ..... A63B 67/187 473/580
3,089,704 A * 5/1963 Wolf ..... A63B 67/18 273/DIG. 4
3,904,205 A * 9/1975 Robinson ..... A63B 67/193 473/579
4,657,262 A * 4/1987 Buckland ..... A63B 67/19 473/580
6,045,469 A * 4/2000 Gleason ..... A63B 43/002 273/DIG. 20
6,227,991 B1 * 5/2001 Carlton ..... A63B 67/187 473/580
6,267,378 B1 * 7/2001 Kanbar ..... A63F 9/02 273/342
6,612,577 B1 * 9/2003 Tiffin ..... A63F 9/0415 273/288
9,132,328 B1 * 9/2015 Daole ..... A63B 67/18
2016/0107046 A1 * 4/2016 Krysiak ..... G09B 19/0038 473/605
2016/0193793 A1 * 7/2016 Filippini ..... A63C 17/01 264/138

* cited by examiner

*Primary Examiner* — Michael D Dennis
(74) *Attorney, Agent, or Firm* — Thomas M. Freiburger

(57) ABSTRACT

A bounce game played on a table or other surface includes a series of game pieces, each with a rounded bottom section with rounded surface downward, of a high-bounce rubber material. Secured to the top of the bottom section is a top section of very lightweight material. In a preferred form the bottom section of the game piece comprises at least about seventy percent of the total weight of the game piece. The game piece when placed on a surface will wobble but not topple over. Players toss a game piece down against the table such that the game piece bounces forward, with the object being to land it in a container such as a drinking glass on the table. To win a game is to be most successful at bouncing game pieces into the glass.

12 Claims, 5 Drawing Sheets

FLIPPING BOUNCE GAME

BACKGROUND OF THE INVENTION

This application claims benefit of provisional patent application Ser. No. 63/025,783, filed May 15, 2020.

This invention concerns games played on a surface such as a table or a floor, and particularly the invention concerns the configuration and bounce characteristics of a collection of high-bounce game pieces, and a game in which players attempt to land them in an open-topped container or on a target.

A myriad of different of games have been developed for competition among players, many of which have involved accurately landing an object in a hole or a recess. For example, an outdoor game called "corn-hole" has players tossing small sandbag type game pieces over a distance of about ten, twenty or thirty feet in an attempt to land game pieces in a hole through a board. Indoor table games have also involved tossing game pieces, one example being beer pong, wherein ping pong balls are bounced by players on a surface table in an attempt to land them in one of a series of open-topped cups. The game of the current invention differs from many of these prior games, by providing high-bounce game pieces which always remain upright, but which can be bounced off a table surface in an attempt to land them in an open-topped vessel such as a glass, or on another form of target.

SUMMARY OF THE INVENTION

This invention is a game involving bouncing of game pieces with rounded or half-spherical, high-bounce bottoms and lightweight tops, preferably cylindrical, and the invention encompasses the game pieces themselves as well as the game. The half-sphere flipping cylinder creates a unique flipping action when bounced. The bottom of the game piece is rounded, preferably a half-sphere made out of a high-bounce rubber material. The top of the game piece is considerably taller than the bottom and is made from an ultra-lightweight material such as EVA foam. The bottom is preferably at least about 80% of the total weight (or about 70% to 90%), which creates a unique flipping action when bounced. This design causes the game piece always to stand up on a surface, possibly wobbling with the top being taller, but never tipping over. The top of the game piece can be shaped like a cylinder (with decoration), cartoonish figure, or any other object. The game piece can be a stand-alone product or used as part of a game, or for any of several different games that can be played.

To play the game, one or more game pieces are bounced on a flat surface (e.g. a table) toward a target. These game pieces can have numbers or symbols printed on the bottom to give them value, like dice. This skill action game can be played in multiple ways.

Target Game:

Bounce the game piece into or onto a target such as a cup or designated area. The player tosses the game piece bottom-first at an angle against a table or other surface.

Target plus value:

Bounce the game piece into or onto a target, from a table or other surface. The added up value of the game pieces on the target gives the players their score. One example is "21", where six game pieces are bounced at a target by each player. Each game piece is assigned a number from 1 to 6. The player with the highest score wins. The highest score possible is 21, and ties are dealt with by shoot outs.

Random values:

Game piece used as "dice" with dice indicia on bottoms, to randomly generate numbers, with the players not knowing the value of the game piece in hand.

Sticky target:

Game piece is bounced onto a "sticky" target using a TPR (thermal plastic rubber) material. This target may have numbers or values indicated to show how close the player is to the center target. Additional targets can be added to targets such as a cup or container.

DESCRIPTION OF PREFERRED EMBODIMENTS

Figure 1:
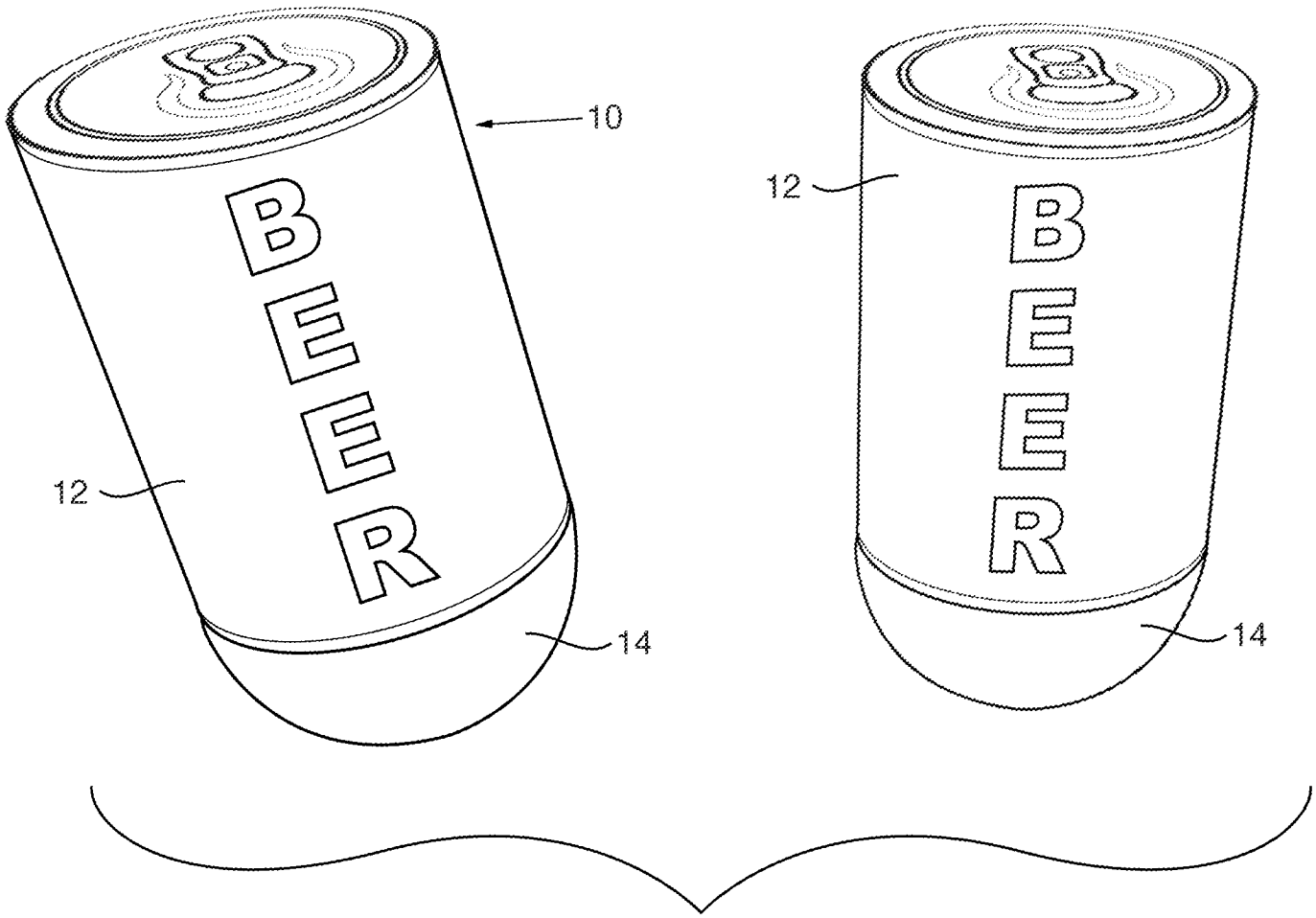
FIG. 1 is a perspective view showing game pieces of the invention positioned on a surface.

FIG. 1 shows an example of game pieces 10 as part of the game of the invention. In this preferred form each game piece 10 is made up of two parts, a top 12 and a bottom 14. The bottom portion can be a clear "high bounce rubber" or synthetic polymer polybutadiene along with other materials. The top half is made of a lightweight foam or EVA. Different materials can be used to get the same effect, such as, for example, an air-filled rubber ball. The shape and weight proportions are crucial to their unique performance.

In one example, the size of the half-sphere is one inch diameter× ½ inch height. The top can be 1½ inch tall, 1 inch diameter, for a total height of 2 inches. The half-sphere is not limited in size and can be created much larger or smaller. For example, it can be the size of a basketball and played outside on a blacktop. One example of a game piece would be a simulated beer keg with a rounded bottom, or as shown a beer or beverage can.

The half-sphere has a round bottom, and in one embodiment a can shape for the top to mimic a "beer" or "soda" can. The style is not limited to a cylinder and could be a bottle, a character, or any other form or style that maintains the overall proportion to get the same "flip" effect.

The foam top half 12 can be decorated to feature a symbol, character, or licensed brand, such as beer or soft drinks as shown. This can be printed directly on the top half or by the use of a printed shrink wrap material.

Individual game activities can be played with one or more game pieces alone, without the need for group gameplay.

Bounce characteristics: If the game piece is held bottom-down and dropped straight down from a height of 20 inches onto a hard surface, it will bounce up 15 inches (or at least 12 inches), typically with one rotation (flip) in the air. As it loses momentum it tends to flip three to five more times as it repeatedly bounces less high each bounce.

Figure 2B:
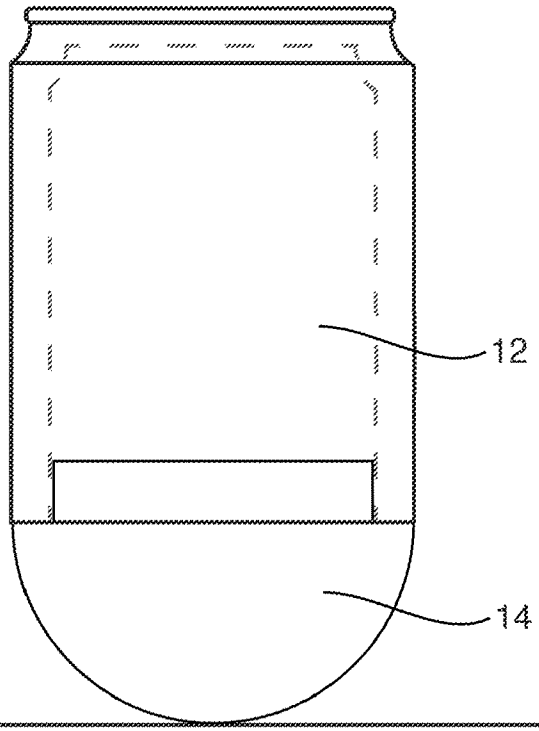
FIGS. 2A and 2B are views showing details of game pieces and their construction.
Figure 2A:
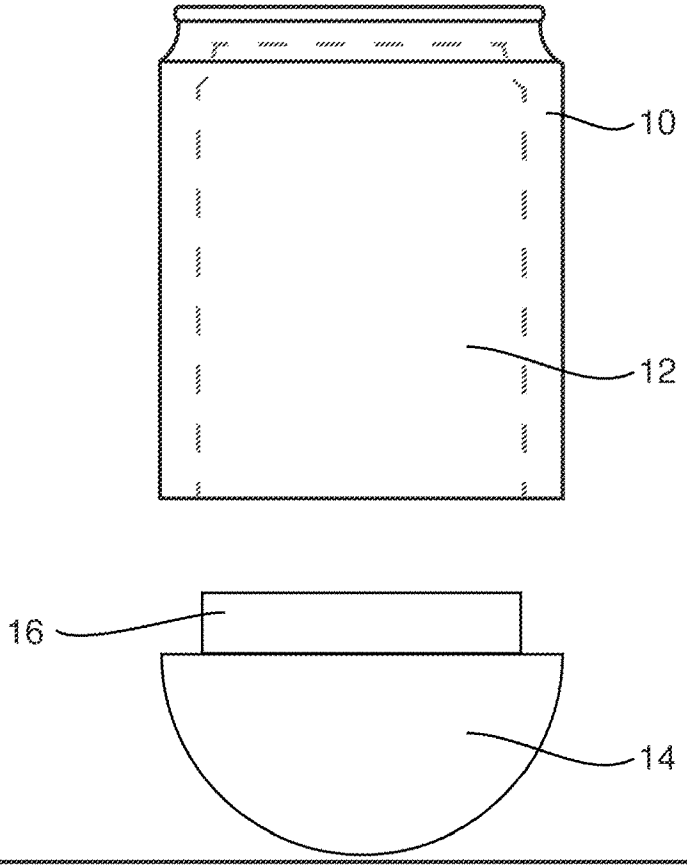

FIGS. 2A and 2B are exploded and side views of a game piece 10 such as those shown in FIG. 1. The upper section 10, of lightweight foam or lightweight material (which could be an inflated cylindrical or otherwise-shaped bag) may be secured to the bottom section 14 as indicated in FIGS. 2A and 2B. The top section if foam can have a recess which closely fits over a narrowed annular collar 16 at the upper side of the lower section 14, such that the collar 16 fits closely in the top section's cavity and can be firmly retained therein by adhesive or by other means such as heat bonding.

Figure 3:
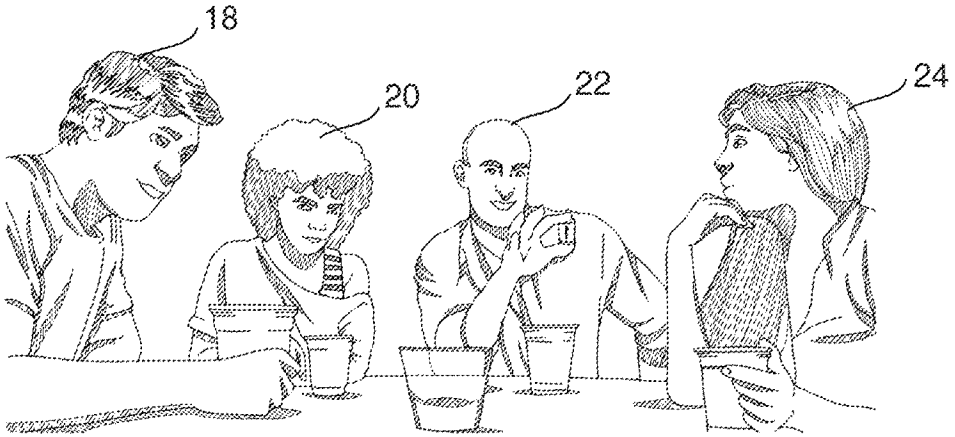
FIG. 3 is a perspective view indicating a game being played.
Figure 4:
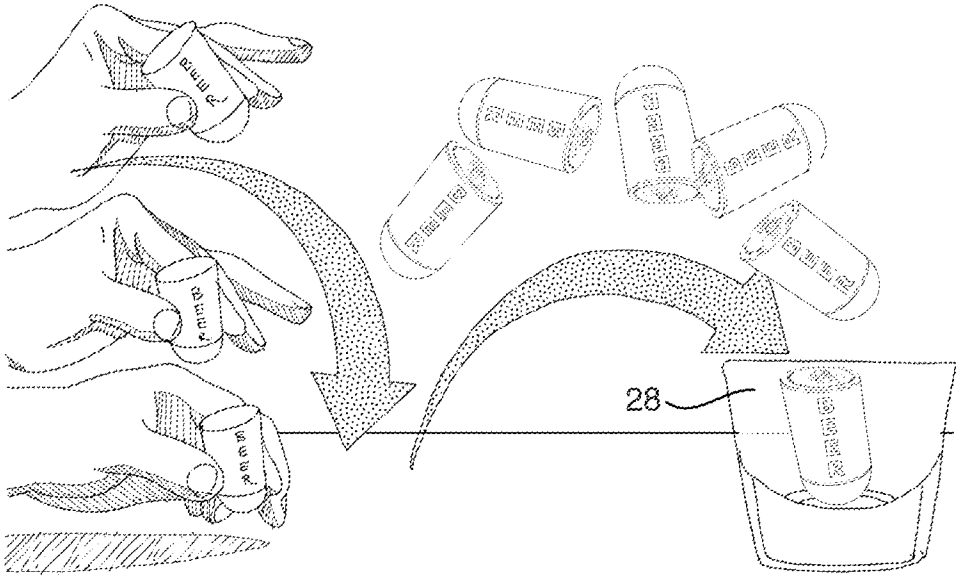
FIG. 4 is a perspective view demonstrating the bouncing of a game piece in an attempt to land a game piece in a vessel.

FIG. 3 shows four players 18, 20, 22 and 24 seated at a table 26 for playing the game of the invention. An open topped cup or other vessel 28 is placed somewhere on the table and the player 22 seeks to bounce the game piece 10 off the table and into the cup, as indicated in FIG. 4. The player must toss the game piece at an oblique angle down against the surface 26, and FIG. 4 indicates the motions of the player, who will release the game piece 10 from his hand prior to the hand and game piece reaching the table. FIG. 4 indicates the game piece accurately landing in the vessel 28, which requires skill and practice.

The play can continue around the table in a clockwise or counterclockwise direction. Each player can have a single game piece or several game pieces, depending on how they want to play the game. In any event, after a number of rounds of play there will be a winner, and this can be determined by a fixed number of tosses per player, or by the first to reach a certain score, such as 21.

Figure 6:
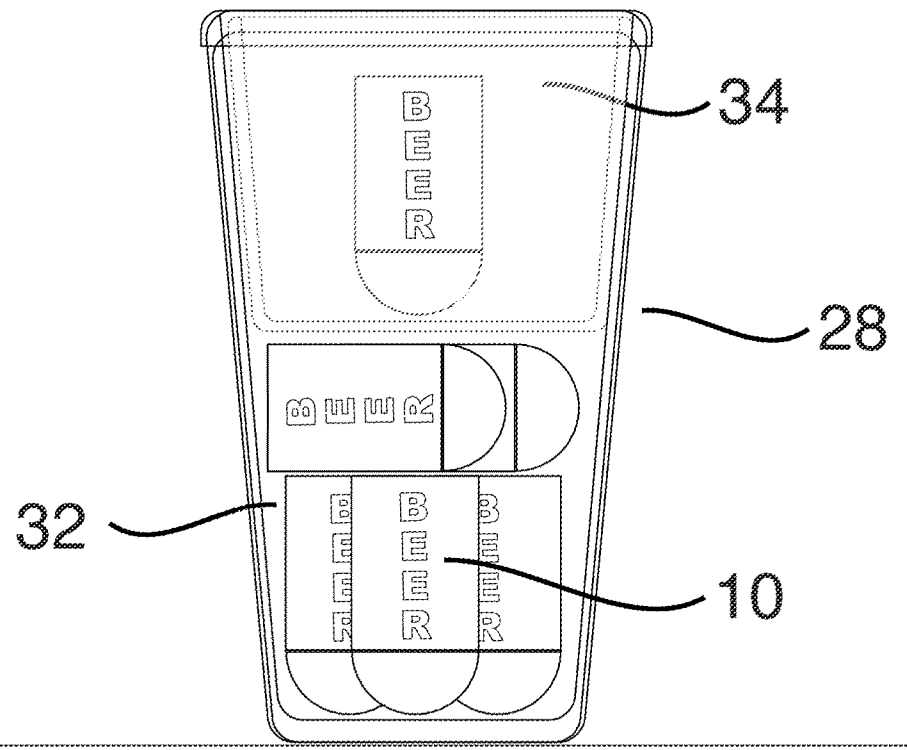
FIG. 6 is an exploded view indicating one arrangement for the object or vessel.
Figure 5:
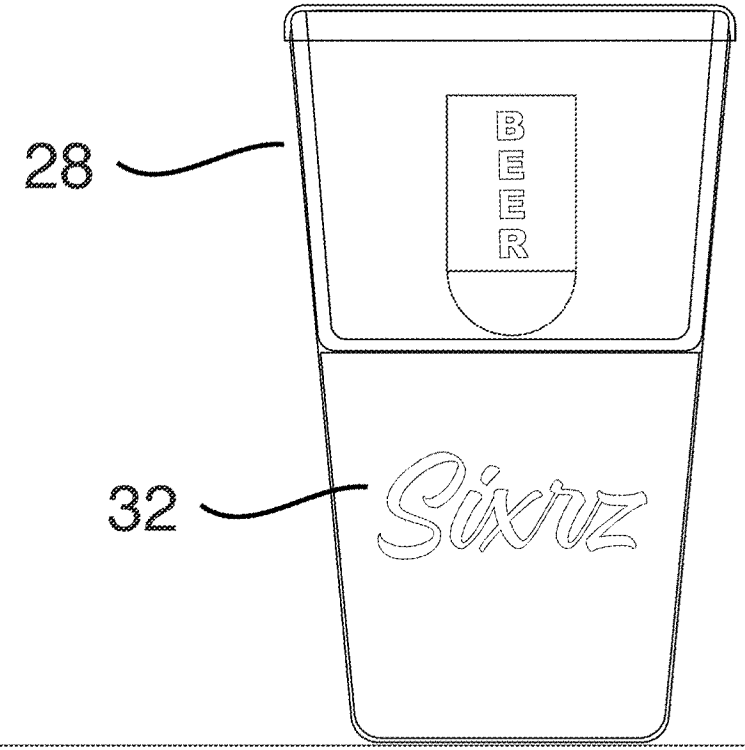
FIG. 5 is a side view showing a glass or other vessel as a target for game pieces.

FIG. 5 shows that the glass or vessel 28 can be made shallower, with a cylindrical or tapered insert 32 (or simply a space) occupying a bottom portion of the glass. The reason for this is to provide a storage place for the game pieces. FIG. 6 shows that the insert or space 32 can hold a plurality of the game pieces 10, with an inner cup 34 inserted in to fill the remaining height of the glass or vessel 28, and the cup 34 can be the landing place for bounced game pieces.

Figure 8:
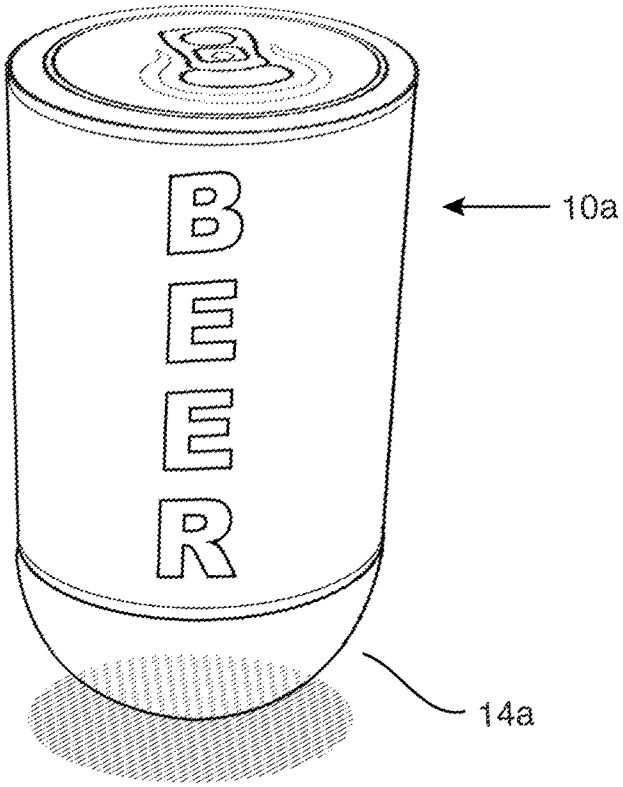
FIG. 8 is a perspective view of the game piece of FIG. 7, positioned on a table.
Figure 7:
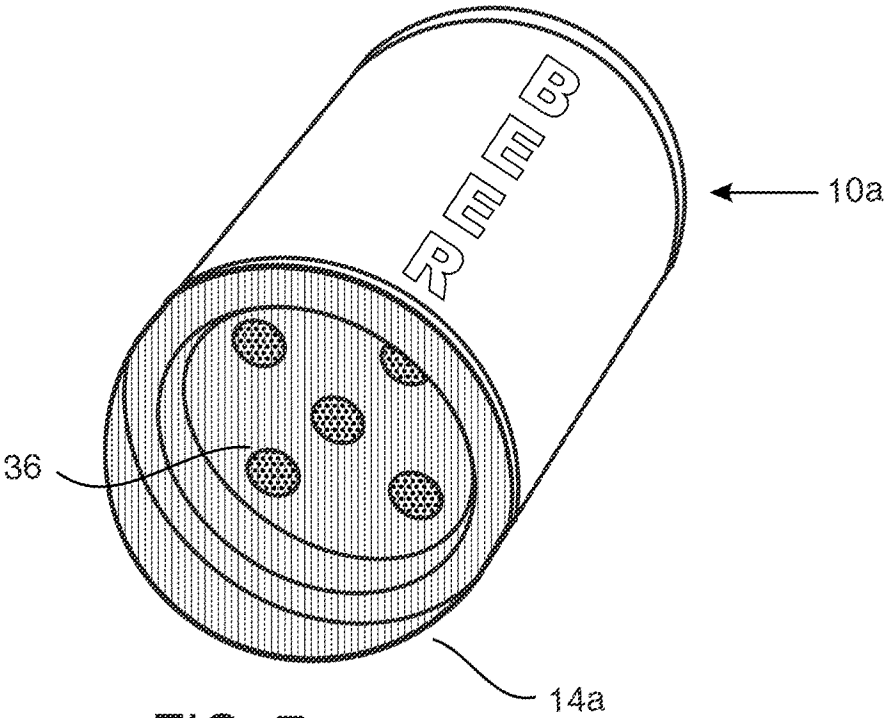
FIG. 7 is a perspective view showing the bottom of a game piece in a particular embodiment.

FIGS. 7 and 8 show a variation, as mentioned above, wherein the game pieces 10*a* can have a different bottom section 14*a*, a clear, substantially transparent material, which may have the same bounce characteristics as noted above, or which can be an inflated half-ball with good bounce characteristics. This will reveal a die indicia on the bottom of the upper section 10*a* (or included in the top of the bottom section). In this case the die 36 shows the number 5, for a dice game involving the game pieces. As mentioned above, each player can use six game pieces, with dice indications for 1 through 6, and the scoring can be based on the value of each game piece successfully bounced into a vessel 28, or to rest in a target area after bouncing, or to stick on a sticky board as noted above.

Although the generally half-spherical shape depicted herein is preferred for the game piece bottoms, the bottoms can take other shapes as well, as long as they are rounded for somewhat predictable bouncing.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A set of game pieces for playing a bounce game on a rigid surface such as a table, comprising:

a plurality of game pieces, each including a round bottom section with a rounded surface downward, and a top section secured to a top side of the bottom section, the bottom section being formed of a resilient rubber material and the top section being formed of a much lighter material, and the bottom section comprising at least about 80% of the total weight of the game piece, and the top section being taller than the bottom section, such that the game piece bounces high when cast against a generally horizontal rigid surface and can wobble but not topple when placed on the rigid surface, the round bottom section being generally half spherical and about one inch in diameter and about ½ inch in height, with the top section being at least one inch in height, and the top section being about 1½ inch in height and about one inch in diameter, whereby a game of bouncing the game pieces can be played by casting the game pieces down against a rigid surface in an attempt to bounce the game piece to land at a desired place.

2. The set of game pieces as in claim 1, wherein the bottom section comprises synthetic polybutadiene.

3. The set of game pieces as in claim 1, wherein the top section is formed of EVA foam.

4. The set of game pieces as in claim 1, wherein the top section is formed of an air-filled sac.

5. The set of game pieces as in claim 1, wherein the top section of the game piece is in the shape of and with the markings of a beer or other beverage can.

6. The set of game pieces as in claim 1, wherein the top section is in a shape of a three-dimensional cartoon character.

7. The set of game pieces as in claim 1, wherein the bottom section comprises at least about 85% of total weight of the game pieces.

8. The set of game pieces as in claim 1, each game piece having a bounce characteristic such that when held bottom-down and dropped from a height of 20 inches onto a rigid surface, it will bounce up at least 12 inches and will flip over during the bounce.

9. The set of game pieces as in claim 1, each game piece having a bounce characteristic such that when held bottom-down and dropped from a height of 20 inches onto a rigid surface, it will bounce up at least 15 inches.

10. A set of game pieces for playing a bounce game on a rigid surface such as a table, comprising:

a plurality of game pieces, each including a round bottom section with a rounded surface downward, and a top section secured to a top side of the bottom section, the bottom section being formed of a high-bounce rubber material and the top section being formed of a light-weight material, the bottom section being generally half spherical with an outer diameter, and the top section being cylindrical and having a diameter essentially the same as said outer diameter, the game piece having a bounce characteristic such that when held bottom-down and dropped from a selected height onto a rigid surface, it will bounce back up at least 60% of the selected height, and the bottom section comprising at least about 85% of the total weight of the game piece, and the top section being taller than the bottom section, such that the game piece when cast against a generally horizontal rigid surface bounces high and flips over in the bounce, and weight distribution of the game piece being such that when placed on the rigid surface the game piece can wobble but cannot topple, whereby a game of bouncing the game pieces can be played by casting each game piece down against a rigid surface to bounce and flip over the game piece in an attempt to land the game piece at a desired place.

11. The set of game pieces as in claim 10, wherein the game piece is configured and has a bounce characteristic such that when held bottom-down and dropped from a height of 20 inches onto a rigid surface, it will bounce up at least 15 inches.

12. The set of game pieces as in claim 10, the game piece having a bounce characteristic such that when held bottom-down and dropped from a selected height onto a rigid surface, it will bounce back up at least 75% of the selected height.

* * * * *